US009284931B2

(12) United States Patent
Brostrom et al.

(10) Patent No.: US 9,284,931 B2
(45) Date of Patent: Mar. 15, 2016

(54) ENGINE FUEL PUMP AND METHOD FOR OPERATION THEREOF

(71) Applicant: Ford Global Technologies, LLC, Dearborn, MI (US)

(72) Inventors: Patrick Brostrom, White Lake, MI (US); Vince Paul Solferino, Dearborn, MI (US); Paul Zeng, Inkster, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 280 days.

(21) Appl. No.: 13/950,181

(22) Filed: Jul. 24, 2013

(65) Prior Publication Data

US 2015/0027416 A1 Jan. 29, 2015

(51) Int. Cl.

| | |
|---|---|
| ***F02M 59/46*** | (2006.01) |
| ***F02D 41/38*** | (2006.01) |
| ***F02M 59/20*** | (2006.01) |
| ***F02M 59/36*** | (2006.01) |

(52) U.S. Cl.

CPC ..... *F02M 59/462* (2013.01); *F02D 41/3845* (2013.01); *F02M 59/20* (2013.01); *F02M 59/368* (2013.01); *F02M 59/464* (2013.01); *F02D 2200/101* (2013.01); *F02M 2200/09* (2013.01)

(58) Field of Classification Search

CPC ... F02M 59/366; F02M 59/466; F02M 45/06; F04B 39/0027; F04B 49/06

USPC ..... 123/495, 496, 497, 499, 446; 417/505, 417/437, 540

See application file for complete search history.

(56) References Cited

U.S. PATENT DOCUMENTS

| | | | | |
|---|---|---|---|---|
| 4,308,475 | A * | 12/1981 | Haeck | 310/30 |
| 4,352,645 | A * | 10/1982 | Meyer | 417/417 |
| 6,447,273 | B1 * | 9/2002 | Nishimura et al. | 417/505 |
| 7,552,720 | B2 * | 6/2009 | Borg et al. | 123/508 |
| 7,677,872 | B2 | 3/2010 | Beardmore | |
| 7,730,875 | B2 * | 6/2010 | Mori et al. | 123/446 |
| 7,827,967 | B2 * | 11/2010 | Beardmore | 123/506 |
| 8,245,693 | B2 | 8/2012 | Surnilla et al. | |
| 2010/0101538 | A1 * | 4/2010 | Beardmore | 123/495 |
| 2011/0097228 | A1 | 4/2011 | Tokuo et al. | |
| 2011/0265765 | A1 * | 11/2011 | Furuhashi et al. | 123/446 |
| 2012/0118271 | A1 * | 5/2012 | Borg et al. | 123/495 |
| 2012/0251367 | A1 * | 10/2012 | Furuhashi et al. | 417/505 |
| 2013/0032212 | A1 | 2/2013 | Tokuo et al. | |
| 2013/0213359 | A1 | 8/2013 | Zeng et al. | |
| 2013/0213360 | A1 | 8/2013 | Zeng et al. | |
| 2013/0213361 | A1 | 8/2013 | Zeng et al. | |

OTHER PUBLICATIONS

Zeng, Paul et al., "High Pressure Fuel Pump," U.S. Appl. No. 13/658,701, filed Oct. 23, 2012, 27 pages.

Zeng, Paul et al., "Fuel Pump With Metering Valve," U.S. Appl. No. 13/706,131, filed Dec. 5, 2012, 36 pages.

Stickler, Mark L. et al., "Pressure Device to Reduce Ticking Noise During Engine Idling," U.S. Appl. No. 14/286,648, filed May 23, 2014, 58 pages.

* cited by examiner

*Primary Examiner* — Lindsay Low
*Assistant Examiner* — Long T Tran
(74) *Attorney, Agent, or Firm* — James Dottavio; Alleman Hall McCoy Russell & Tuttle LLP

(57) ABSTRACT

A method of pressuring fuel for a direct injection fuel system via a fuel pump in an engine is provided. The method includes, during a first mode, adjusting a magnetic solenoid valve (MSV) to control pump outlet pressure and during a second mode, deactivating the MSV and controlling pump outlet pressure via a noise-reducing valve assembly on an inlet side of the fuel pump.

19 Claims, 11 Drawing Sheets

ENGINE FUEL PUMP AND METHOD FOR OPERATION THEREOF

FIELD

The present disclosure relates to a fuel delivery system having a fuel pump in an engine.

BACKGROUND AND SUMMARY

Fuel pumps are used in engine's to pressurize fuel in a fuel delivery system. Some fuel delivery systems are designed for high pressure fuel delivery for direct injection systems. Magnetic solenoid valves (MSV) are utilized in fuel pumps to regulate the fuel flow into a pump chamber during fuel pump operation. Specifically, solenoid valves in fuel pumps may be operated to selectively permit and inhibit fuel flow into a pump chamber from a fuel pump inlet. As a result, the pump chamber may receive fuel from the inlet during an intake stroke and deliver pressurized fuel to downstream components during a delivery stroke.

US 2011/0097228 discloses a high pressure fuel pump having multiple solenoid valves for adjusting the amount of fuel delivered to a fuel rail from the high pressure fuel pump However, the solenoid valve disclosed in US 2011/0097228 may generated ticks, vibrations, etc., during pump operation when the solenoid valve is activated. Therefore, noise, vibration, and harshness (NVH) may be increased in the engine via the high pressure fuel pump disclosed 2011/0097228 and other fuel pumps utilizing solenoid valves. The NVH may not only harm the fuel pump but may also degrade surrounding components. As a result, customer satisfaction may be decreased, component longevity may also be deceased, and the likelihood of component failure may be increased when NVH is generated by the solenoid valve.

The inventors herein have recognized the above issues and developed a method of pressuring fuel for a direct injection fuel system via a fuel pump in an engine. The method includes, during a first mode, adjusting a magnetic solenoid valve (MSV) to control pump outlet pressure and during a second mode, deactivating the MSV and controlling pump outlet pressure via a noise-reducing valve assembly on an inlet side of the fuel pump.

In this way, the solenoid valve in the fuel pump may be disabled for a selected period of time, such as idle or other selected operating conditions while the noise-reducing valve functions to control the pump outlet pressure. Thus, the window of operation of the solenoid valve is decreased, thereby decreasing NVH in the pump generated by the solenoid valve. As a result, component longevity and customer satisfaction are increased. Further it will be appreciated that in some examples the noise-reducing may be passively actuated. Therefore, the noise-reducing valve may generate a small amount of (e.g., substantially zero) NVH when compared to the solenoid valve. Consequently, the technical results achieved via the fuel pump include reducing the NVH generated in the pump during certain operating conditions, such as during idle and/or other low speed conditions, while still providing sufficient pressure control and fuel supply to the fuel pump so that sufficient fuel can be delivered to the engine.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure. Additionally, the above issues have been recognized by the inventors herein, and are not admitted to be known.

DETAILED DESCRIPTION

A fuel pump for an engine is described herein. The fuel pump is configured to reduce noise, vibration, and harshness (NVH) generated via the fuel pump. The fuel pump includes a noise-reducing valve that enables a magnetic solenoid valve (MSV) to be deactivated during certain time intervals of fuel pump operation. For instance, the MSV may be deactivated in an open positioned during a delivery stroke and/or during idle operation when the engine is operating below a threshold speed. In this way, the window of operation of the solenoid valve is decreased, thereby decreasing NVH in the pump generated by the solenoid valve. As a result, the longevity of the fuel pump and the surrounding components is increased and customer satisfaction is also increased.

Figure 1:
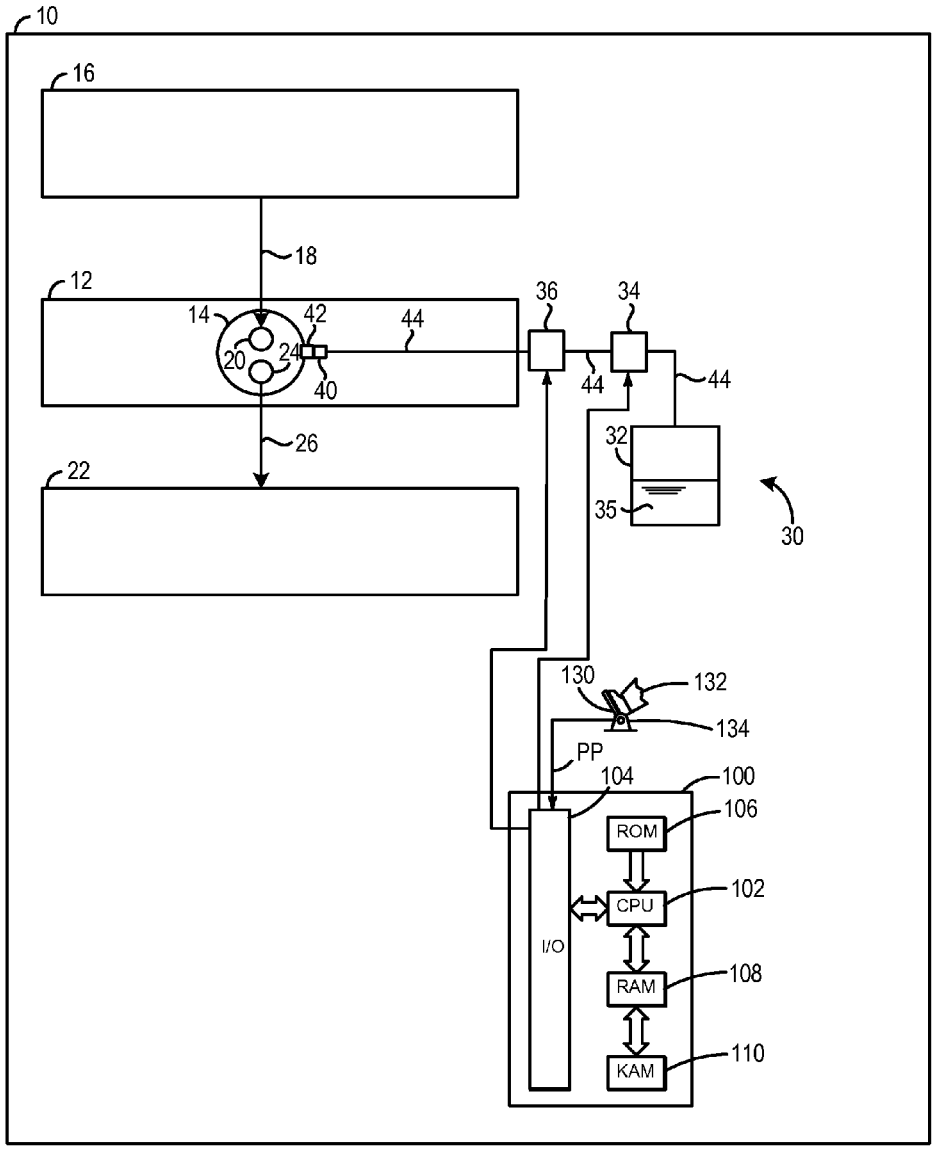
FIG. 1 shows a schematic depiction of a vehicle having an engine and a fuel delivery system.

FIG. 1 shows a schematic depiction of a vehicle 10 including an engine 12. The engine 12 is configured to implement combustion operation. For example, a four stroke combustion cycle may be implemented including an intake stroke, a compression stroke, a power stroke, and an exhaust stroke. However, other types of combustion cycles may be utilized in other examples. In this way, motive power may be generated in the vehicle 10. It will be appreciated that the engine may be coupled to a transmission for transferring rotation power generated in the engine to wheels in the vehicle.

The engine 12 includes at least one cylinder 14. However, engines having different cylinder configurations have been contemplated. For instance, the cylinder may be arranged in an inline configuration where the cylinders are positioned in a straight line, a horizontally opposed configuration, a V-configuration, etc.

An intake system 16 is configured to provide air to the cylinder 14. The intake system 16 may include a variety of components for achieving the aforementioned functionality such as a throttle, an intake manifold, compressor, intake conduits, etc. As shown, the intake system 16 is in fluidic communication with the cylinder 14, denoted via arrow 18. It will be appreciated that one or more conduits, passages, etc., may provide the fluidic communication denoted via arrow 18. An intake valve 20 included in the intake system 16 may provide the fluidic communication between the intake system and the cylinder. The intake valve 20 may be cyclically opened and closed to implement combustion operation in the engine.

Furthermore, the engine further includes an exhaust system 22 configured to receive exhaust gas from the cylinder 14. The exhaust system may include manifolds, conduits, passages, emission control devices (e.g., catalysts, filters, etc.), mufflers, etc. An exhaust valve 24 coupled to the cylinder 14 is included in the exhaust system 22. The exhaust valve 24 may be configured to cyclically open and close during combustion operation. The exhaust system 22 is in fluidic communication with the cylinder 14, denoted via arrow 26. Specifically, arrow 26 may indicate exhaust passages, conduits, etc., providing fluidic communication between the cylinder 14 and the exhaust valve 24. The exhaust valve may be configured to cyclically open and close to enable combustion operation.

The vehicle 10 further includes a fuel delivery system 30. The fuel delivery system 30 having a fuel tank 32 and a first fuel pump 34 (e.g., low pressure fuel pump) configured to flow fuel to downstream components. The fuel tank 32 stores a liquid fuel 35 (e.g., gasoline, diesel, ethanol, etc.). The fuel delivery system 30 further includes a second fuel pump 36 (e.g., a high pressure fuel pump). The second fuel pump 36 is in fluidic communication with a fuel rail 40 and a fuel injector 42. It will be appreciated that in other examples the fuel delivery system may include a single fuel pump. A fuel rail 40 is positioned downstream of the second fuel pump 36 and therefore is in fluidic communication with the second fuel pump. A fuel injector 42 is positioned downstream of the fuel rail 40 and therefore is in fluidic communication with the fuel rail 40. The fuel injector 42 is shown directly coupled to the cylinder 14 providing what is known as direct injection. Additionally or alternatively, a port fuel injector may be included in the fuel delivery system configured to provide fuel to an intake conduit upstream of the intake valve. Fuel lines 44 provide the fluidic communication between the fuel tank 32, the first fuel pump 34, the second fuel pump 36, and the fuel rail 40.

A controller 100 may be included in the vehicle. The controller 100 may be configured to receive signals from sensors in the vehicle as well as send command signals to components such as the first fuel pump 34 and/or the second fuel pump 36.

Various components in the vehicle 10 may be controlled at least partially by a control system including the controller 100 and by input from a vehicle operator 132 via an input device 130. In this example, input device 130 includes an accelerator pedal and a pedal position sensor 134 for generating a proportional pedal position signal PP. The controller 100 is shown in FIG. 1 as a microcomputer, including processor 102 (e.g., microprocessor unit), input/output ports 104, an electronic storage medium for executable programs and calibration values shown as read only memory 106 (e.g., read only memory chip) in this particular example, random access memory 108, keep alive memory 110, and a data bus. Storage medium read-only memory 106 can be programmed with computer readable data representing instructions executable by processor 102 for performing the methods described below as well as other variants that are anticipated but not specifically listed. As shown, the fuel pumps (34 and 36) may receive control signals from the controller 100 to facilitate fuel delivery control, discussed in greater detail herein.

FIGS. 2-5 show a first example fuel pump 200 in different modes of operation. It will be appreciated that the fuel pump 200 shown in FIGS. 2-5 may be similar to the fuel pump 36 shown in FIG. 1 and therefore may be included in the fuel delivery system 30, shown in FIG. 1.

Figure 2:
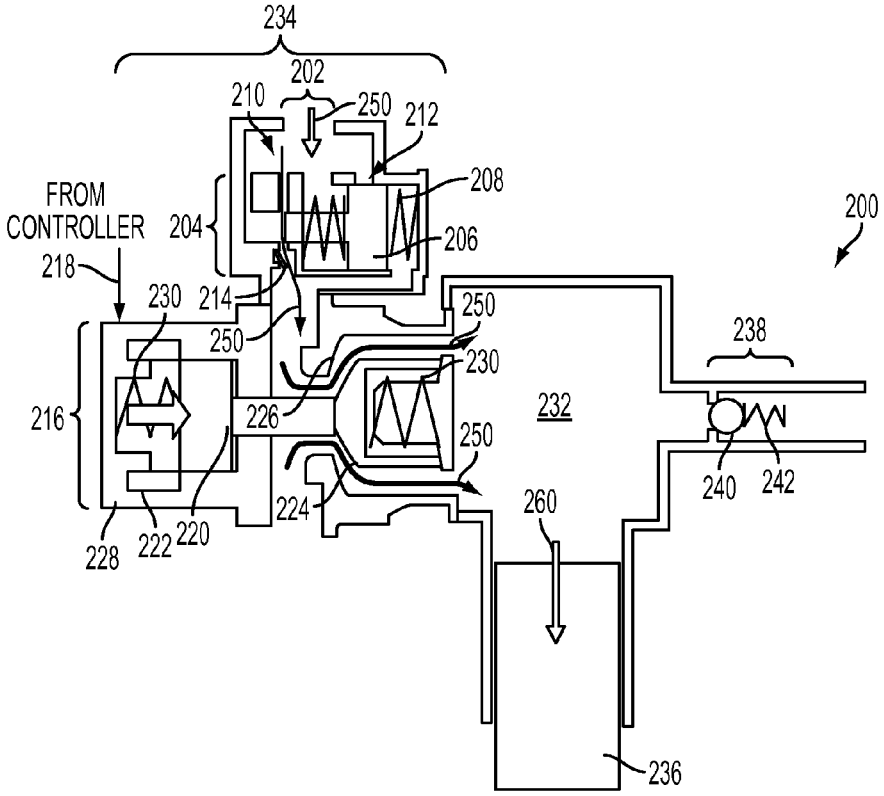
FIGS. 2-5 show a first example fuel pump in different operating configurations.
Figure 3:
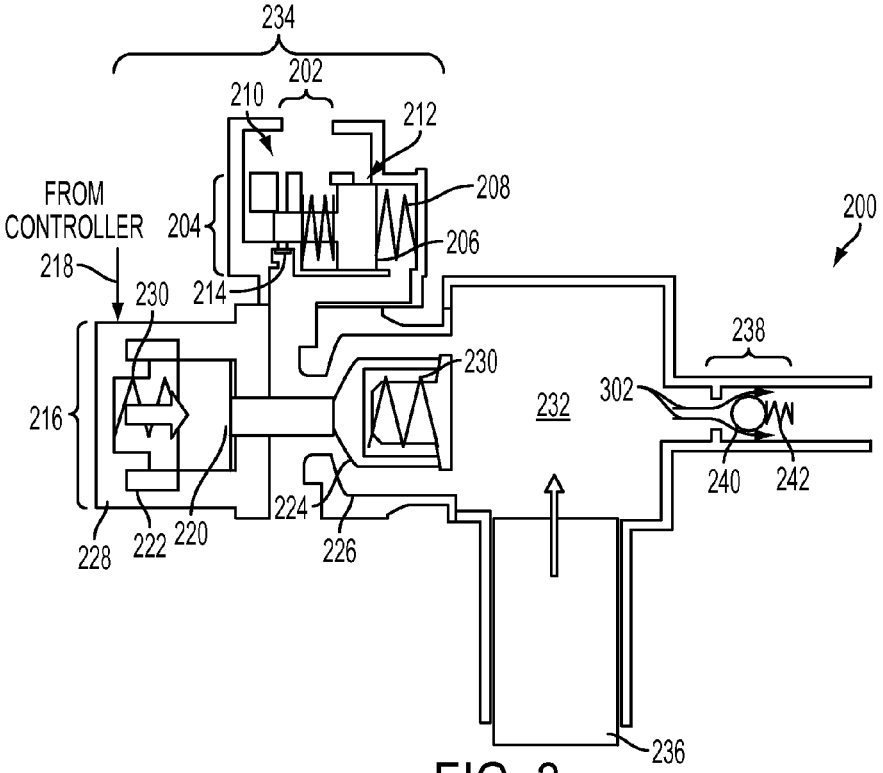
Figure 4:
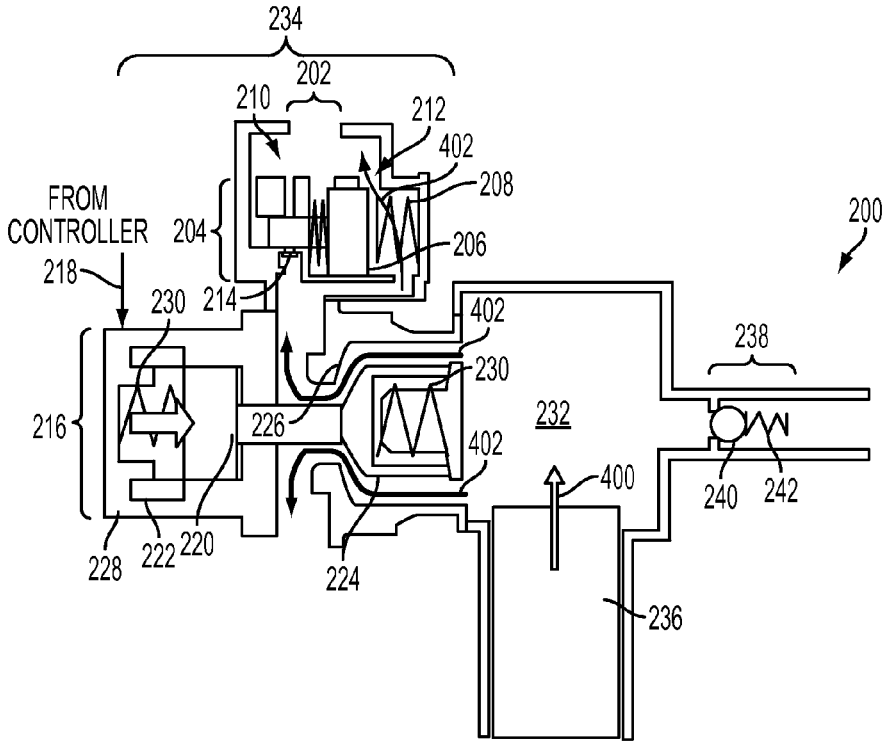

The fuel pump 200 shown in FIGS. 2-4 includes an inlet 202 in fluidic communication with upstream components such as a fuel tank and/or a lower pressure fuel pump.

The fuel pump 200 includes a noise-reducing valve 204 in fluidic communication (e.g., direct fluidic communication) with the inlet 202. The noise-reducing valve 204 is configured to selectively permit and inhibit fuel flow therethrough. The noise-reducing valve 204 includes a moveable member 206, a spring 208, a first port 210, a second port 212 and a reed valve 214. In one example, the noise-reducing valve 204 may be passively controlled via hydraulic pressure in the pump.

The fuel pump 200 further includes a magnetic solenoid valve (MSV) 216. The MSV 216 is in electronic communication with a controller indicated via arrow 218, such as controller 100 shown in FIG. 1. Therefore, the configuration of the MSV 216 may be adjusted via a controller and is discussed in greater detail herein. The MSV 216 includes a core tube 220 at least partially enclosed via a coil 222. A sealing element 224 is coupled (e.g., directly coupled) to the core tube 220. The sealing element 224 is configured to seat on a MSV sealing surface 226 when the MSV is in a closed configuration. Likewise, the sealing element 224 is spaced away from the sealing surface 226 when the MSV is in an open configuration. The MSV 216 also includes a housing 228 at least partially enclosing the coil 222 and the core tube 220.

The core tube 220 and the sealing element 224 move in an axial direction responsive to controller input signal. The MSV further includes a first spring 230 and a second spring 231. The neutral position of the first spring 230 and the second spring 231 may urge the core tube 220 and the sealing element in an open position, permitting fuel to flow through the MSV 216 to a pump chamber 232. On the other hand, in a closed configuration the coil 222 in the MSV 216 may be energized to urge the sealing element 224 towards the sealing surface 226. Therefore, in a closed position the sealing element 224 seats and seals in the sealing surface 226.

As shown, the noise-reducing valve 204 and the MSV 216 are shown positioned on an inlet side 234 of the fuel pump 200. Specifically, the MSV 216 is positioned downstream of the noise-reducing valve 204. However, in other examples the MSV 216 may be positioned upstream of the noise-reducing valve 204. Additionally, as depicted the MSV 216 and the noise-reducing valve 204 are in series fluidic communication. Additionally, in some examples the MSV 216 and the noise-reducing valve 204 may be in parallel fluidic communication.

The fuel pump 200 also includes the pump chamber 232 positioned downstream of the MSV and the noise-reducing valve 204. The pump chamber 232 is therefore in fluidic communication with the aforementioned valves. A plunger 236 may also be included in the fuel pump 200 and is configured to increase and decrease the volume in the pump chamber 232. The plunger 236 may be mechanically coupled to a crankshaft, cams, etc. Thus, the plunger 236 may be cam driven, in one example. Therefore, it will be appreciated that the plunger 236 may move in an upward and downward motion. The plunger 236 may be mechanically driven by an electric motor, crank shaft motion, etc. The plunger enables the pump chamber to drawn in fuel from the fuel tank and release fuel to downstream components, such as a fuel rail.

The fuel pump 200 further includes a one way discharge valve 238 positioned downstream of the pump chamber 232 and an outlet positioned downstream of the one way discharge valve 238. The one way discharge valve 238 may be in fluidic communication with a downstream fuel rail and fuel injector. The one way discharge valve is configured to permit fluid to flow through the valve in a downstream direction when the pressure of fuel in the pump chamber 232 exceeds a threshold valve and inhibit fuel flow in the downstream direction when the pump chamber pressure does not exceed the threshold value. On the other hand the one way discharge valve 238 is configured to inhibit upstream fuel flow. As shown, the one way discharge valve is a check valve including a ball 240 coupled to a spring 242. However, other suitable one way valves may be utilized in other examples.

FIGS. 2-4 show the fuel pump 200 in a first mode where the MSV 216 is deactivated. As shown, the MSV 216 is deactivated in an open positioned where fuel is allowed to flow therethrough. It will be appreciated that deactivation may include an operating condition where a controller is not sending control signals to the MSV and the sealing element in the MSV remains substantially stationary. Therefore, when the MSV is deactivated in the open positioned fuel may flow upstream and downstream through the valve. It will be appreciated that deactivating the MSV reduces noise, vibration, and harshness generated in the fuel pump 200. As a result, the longevity of the pump and surrounding components may be increased and customer satisfaction may also be increased.

Specifically, FIG. 2 shows the fuel pump 200 during an intake stroke when the volume of the pump chamber is increasing and fuel is flowing through the MSV 216 and the noise-reducing valve 204 into the pump chamber 232, indicated via arrows 250. The plunger 236 in moving in a direction, indicated via arrow 260, to increase the volume of the pump chamber 232.

Fuel is shown flowing through the first port 210 and a reed valve 214 in the noise-reducing valve 204. It will be appreciated that the reed valve 214 may act as a one way valve enabling fuel to flow in a downstream direction but inhibiting fuel to flow in an upstream direction into the first port 210. Fuel may flow from the reed valve 214 of the noise-reducing valve 204 to the MSV 216. As shown, the MSV 216 in an open configuration and the valve is deactivated. Therefore, fuel flows through the MSV into the pump chamber 232.

FIG. 3 shows the fuel pump 200 during a delivery stroke where the plunger 236 is moving in a direction, indicated via arrow 300, to decrease the volume of the pump chamber 232.

In FIG. 3, the MSV 216 remains deactivated in an open configuration. However, the noise-reducing valve 204 is reconfigured to substantially inhibit fuel flow therethrough. The noise-reducing valve 204 may be reconfigured via hydraulic pressure in the pump or via a controller. In such a configuration, the first port 210 and the second port 212 are substantially blocked via the moveable member 206. Therefore, the moveable member 206 inhibits fuel from flow through the first and second ports (210 and 212) in the configuration of the noise-reducing valve 204 shown in FIG. 3. As shown, in the fuel pump 200 fuel flows through the one way discharge valve 238, indicated via arrows 302. Fuel may then flow to downstream components such as through a fuel line to a fuel rail and/or a fuel injector. In this way, the noise-reducing valve 204 may be operated during a delivery stroke to enable fuel to be provided to components downstream of the pump.

FIG. 4 shows the fuel pump 200 during a delivery stroke where the plunger 236 is moving in a direction, indicated via arrow 400, to increase the volume of the pump chamber 232. However, in the configuration shown in FIG. 4 fuel is flowed upstream through MSV 216 and the noise-reducing valve 204 as indicated via arrows 402. The fuel may then flow from the noise-reducing valve to components upstream of the pump, such as a fuel tank. In this way, fuel may be substantially inhibited from flowing to downstream components to enable the pump to be active during periods of engine operation when fuel delivery to downstream components from the pump is not desired. In this way, the noise-reducing valve 204 may be passively actuated based on the pressure in the pump chamber 232. As a result, operation of the fuel pump may be more robust and the likelihood of fuel pump control strategy errors may be reduced.

Figure 5:
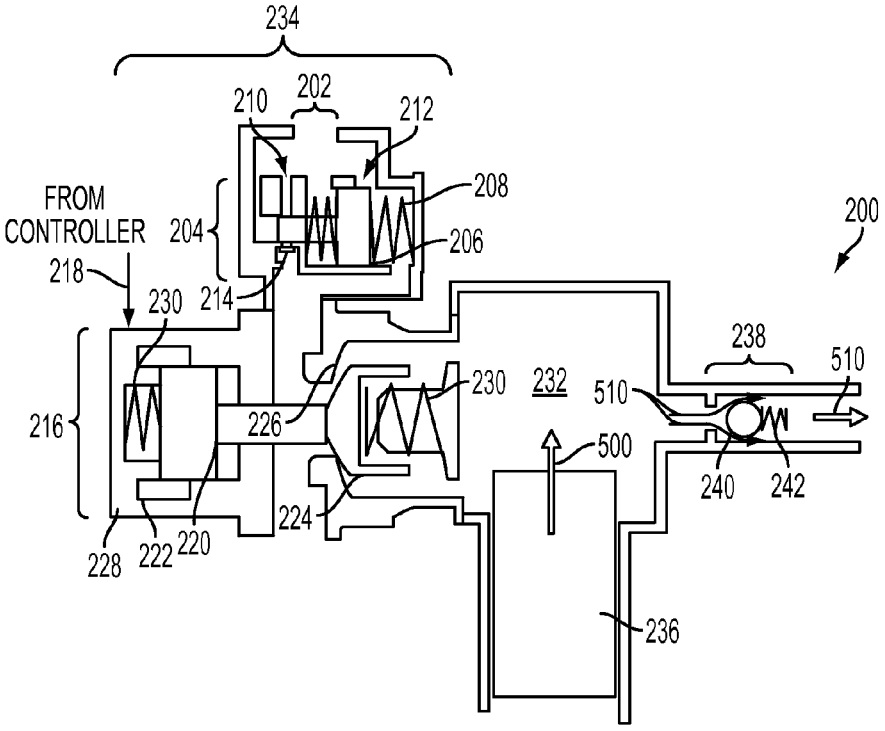

FIG. 5 shows the fuel pump 200 during a delivery stroke when the MSV 216 is activated. The MSV 216 is activated via a controller, such as the controller 100 shown in FIG. 1. Activation of the MSV may include adjusting the position of the sealing element 224 via energizing the coil 222. Thus, it will be appreciated that the controller may energize the oil to alter the position of the sealing element when the MSV is activated. Thus, during activation the MSV receives control signals from a controller. The plunger 236 is moving in a direction indicated via arrow 500 to decrease the volume of the pump chamber 232. As shown, MSV 216 is reconfigured and the sealing element 224 is seated and sealed on sealing surface 226 in the MSV. As a result, fuel is substantially inhibited from flowing upstream through the MSV. As a result, fuel is flowed to downstream components, indicated via arrows 510. It will be appreciated that the MSV may be activated during selected operating conditions, such as during periods of high speed engine operation. For instance, the MSV may be activated when the engine speed surpasses a threshold value. Additionally, the MSV may be deactivated when the engine speed falls below a threshold value.

Figure 6:
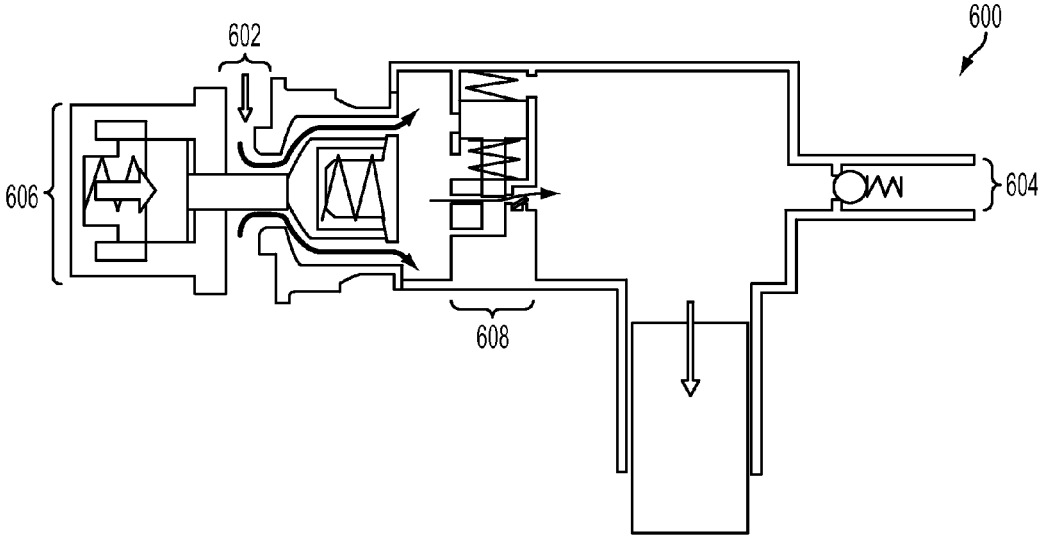
FIG. 6 shows a second example fuel pump.

FIG. 6 shows another example of a fuel pump 600. The fuel pump 600 may be included in the fuel delivery system 30 shown in FIG. 1. Again the fuel pump 600 includes an inlet 602, an outlet 604, an MSV 606 and a noise-reducing valve 608. The MSV 606 may be similar to the MSV 216 shown in FIGS. 2-5. Likewise, the noise-reducing valve 608 may be similar to the noise-reducing valve 204, shown in FIGS. 2-5. Therefore, the MSV 606 and the noise-reducing valve 608 may have similar functionalities to the MSV and noise-reducing valve shown in FIGS. 2-5. As shown, the noise-reducing valve 608 is positioned downstream of the MSV 606.

FIGS. 7-14 show a fuel pump 700 and a noise-reducing valve 702 included in the fuel pump 700 in different configurations. The fuel pump 700 may be included in the fuel delivery system 30 shown in FIG. 1. The fuel pump 700 includes an inlet 702 in fluidic communication with upstream components such as a fuel tank. The fuel pump 700 further includes a noise-reducing valve 704 positioned upstream of a MSV 706. The MSV 706 may have a similar functionality to the MSV 216 shown in FIGS. 2-5. As shown, the MSV 706 receives a control signal from a controller, indicated via arrow 720. The fuel pump 700 further includes a pump chamber 708 and a plunger 710. The pump chamber 708 and the plunger 710 may be similar to the pump chamber 232 and the plunger 236 shown in FIGS. 2-5. Therefore, the plunger 710 may be mechanically coupled to a crankshaft, cams, etc. Thus, the plunger 710 may be cam driven, in one example. The fuel pump 700 further includes a one way discharge valve 712. The one way discharger valve 712 is configured to permit fuel flow in a downstream direction through the valve when a pressure at the valve inlet exceeds a threshold value and substantially inhibits fuel flow through the valve in an upstream direction. The pump 700 further includes an outlet 714 which is in fluidic communication with downstream components such as a fuel rail and/or fuel injector.

The noise-reducing valve 704 is a rotating type spool valve in the example fuel pump 700 shown in FIGS. 7-12. The noise-reducing valve 704 may be adjusted in several configurations. For instance, the noise-reducing valve 704 may be configured to permit and inhibit fuel flow therethrough.

Figure 7:
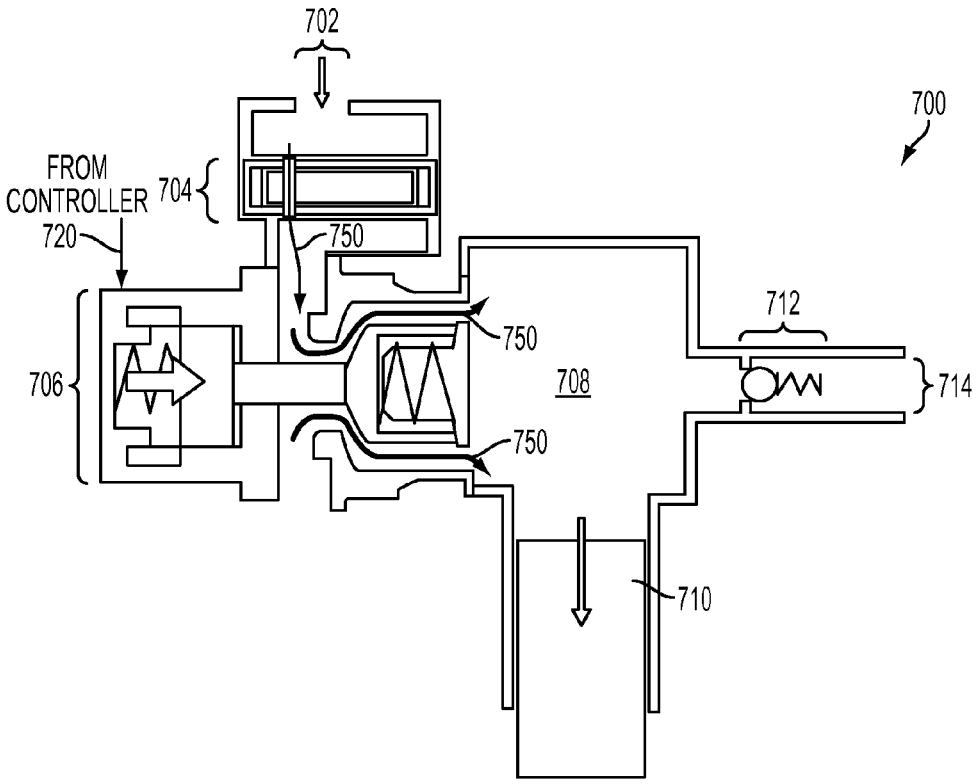
FIGS. 7-14 show a third example fuel pump in different operating configurations.

Specifically, FIG. 7 shows the pump 700 during an intake stroke of the plunger 710 where the volume of the pump chamber 708 is increasing. Additionally, the MSV 706 is deactivated in an open position enabling fuel to flow therethrough. The noise-reducing valve 704 is in a configuration where fuel is permitted to flow therethrough. Thus, fuel flow through the noise-reducing valve 704 and the MSV 706 into the pump chamber 708, indicated via arrows 750. In this way, the noise-reducing valve 706 may be actuated to enable the pump chamber to be refilled during an intake stroke.

Figure 8:
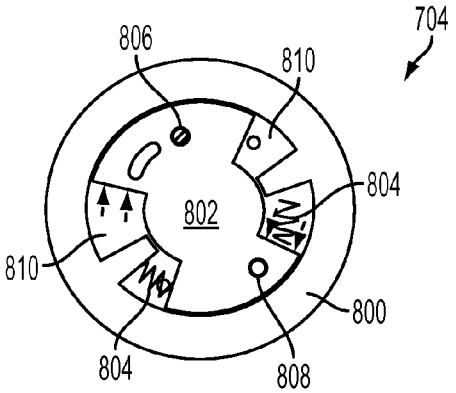

FIG. 8 shows a cross-sectional view of the noise-reducing valve 704. The noise-reducing valve 704 includes a stator 800 at least partially enclosing a rotor 802. The relative position of the rotor 802 and the stator 800 may be adjusted to permit or inhibit fuel flow through the valve. In the configuration shown in FIG. 8 the noise-reducing valve 704 is configured to enable fuel to flow therethrough. The noise-reducing valve 704 further includes springs 804 coupled to the stator 800 and/or the rotor 802. The noise-reducing valve 704 further includes a first opening 806 and a second opening 808. In the configuration shown in FIG. 8 fuel flow through the first opening 806 is blocked and fuel flow through the second opening 808 is permitted. The gaps 810 between the stator 800 and the rotor 802 are in fluidic communication with the pump chamber 708 shown in FIG. 7.

Figure 9:
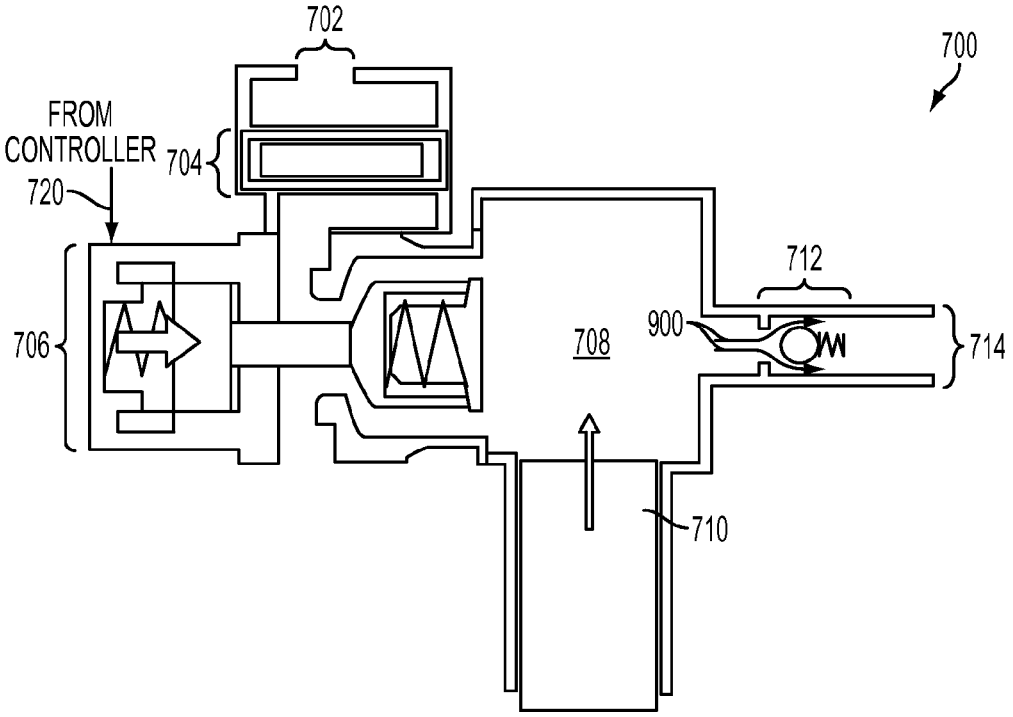

FIG. 9 shows the pump 700 where the MSV 706 is deactivated in an open position and the noise-reducing valve 704 is in a closed configuration where fuel flow is inhibited therethrough. The plunger 710 is performing a delivery stroke, decreasing the volume of the pump chamber 708 and fuel is flowing through the one way discharge valve 712 indicated via arrows 900.

Figure 10:
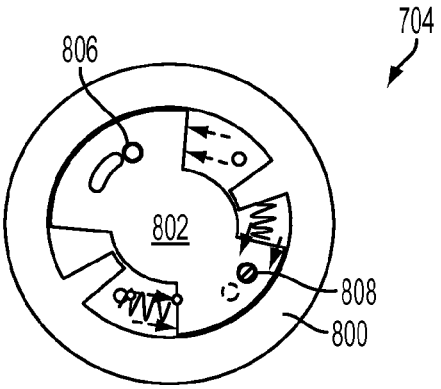

FIG. 10 shows the noise-reducing valve 704 in a closed configuration where fuel flow through the first opening 806 and the second opening 808 are substantially blocked to substantially inhibit fuel flow through the valve. It will be appreciated that the relative position of the rotor 802 and the stator 800 may be adjusted to achieve the aforementioned configuration.

Figure 11:
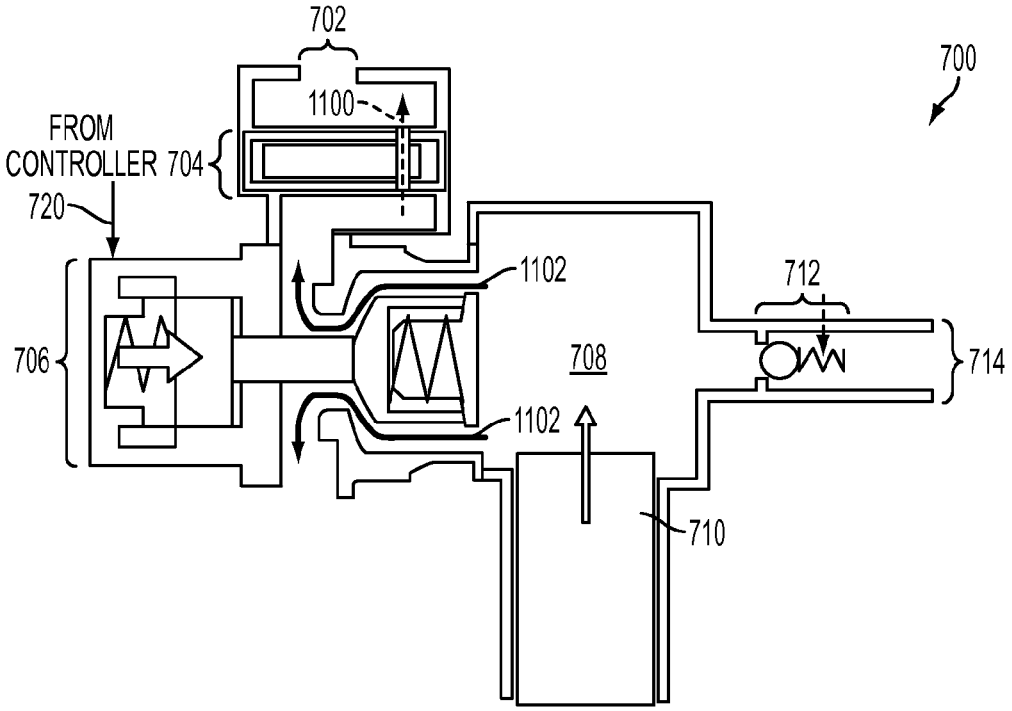

FIG. 11 shows the pump 700 where the MSV 706 is deactivated in an open configuration and the noise-reducing valve 704 is in a second open configuration where fuel flow is permitted therethrough, indicated via arrow 1100. As shown, the plunger 708 is performing a delivery stroke and fuel is flowing upstream through the MSV 706, indicated via arrows 1102, and the noise-reducing valve 704. In this way, the pump 700 may be operated to perform a delivery stroke where fuel is not flowed to downstream components.

Figure 12:
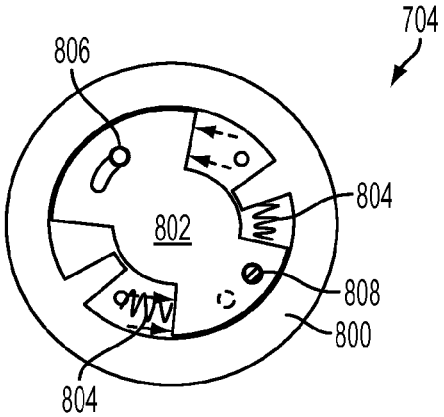

FIG. 12 shows the noise-reducing valve 704 in a second open configuration where fuel flow through the first opening 806 is permitted and fuel flow through the second opening 808 is substantially inhibited. Therefore, fuel is permitted to flow through the noise-reducing valve 704 in the configuration shown in FIG. 12. It will be appreciated that the relative position of the rotor 802 and the stator 800 may be adjusted to achieve the aforementioned configuration.

Figure 13:
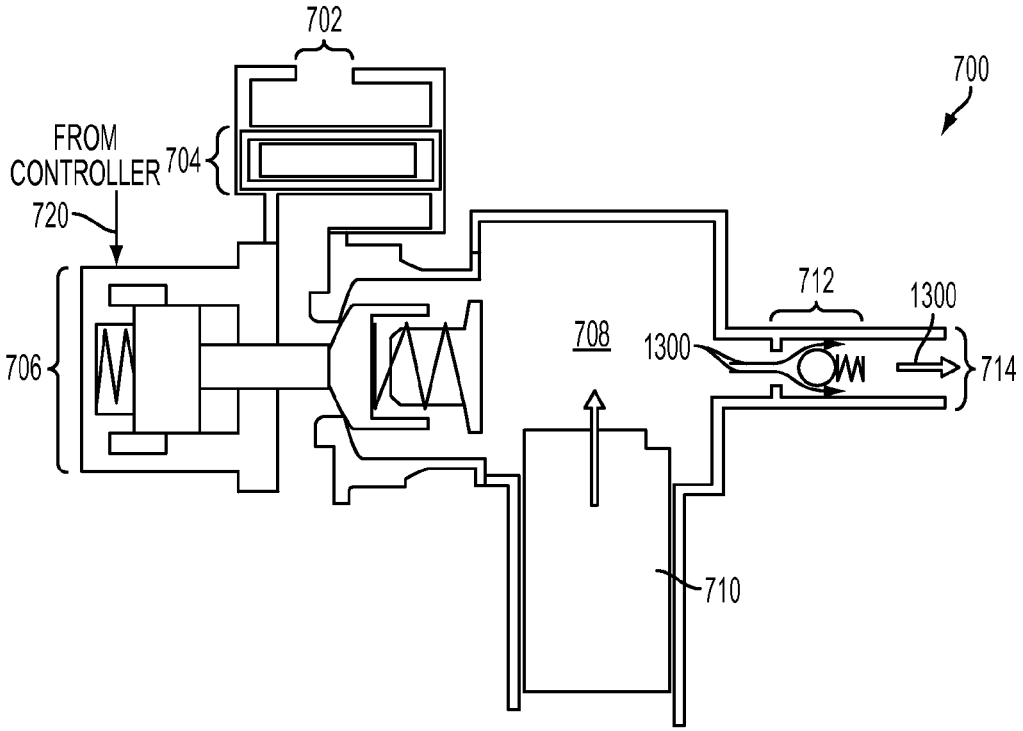

FIG. 13 shows the pump 700 where the MSV 706 is activated in a closed configuration and the noise-reducing valve 704 is in closed configuration where fuel flow is inhibited therethrough. As shown, the plunger 708 is performing a delivery stroke and fuel is flowing downstream through the one way discharge valve 712 and the outlet indicated via arrow 1300. In this way, the pump 700 and specifically the MSV 706 may be operated to perform a delivery stroke where fuel is flowed to downstream components. Therefore, the MSV 706 may be activated to control the amount of fuel delivered to downstream components during certain operating conditions.

Figure 14:
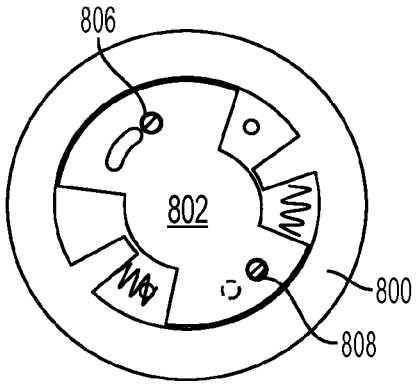

FIG. 14 shows the noise-reducing valve 704 in a closed configuration where fuel flow through the first opening 806 and the second opening 808 are substantially blocked to substantially inhibit fuel flow through the valve. It will be appreciated that the relative position of the rotor 802 and the stator 800 may be adjusted to achieve the aforementioned configuration.

Figure 15:
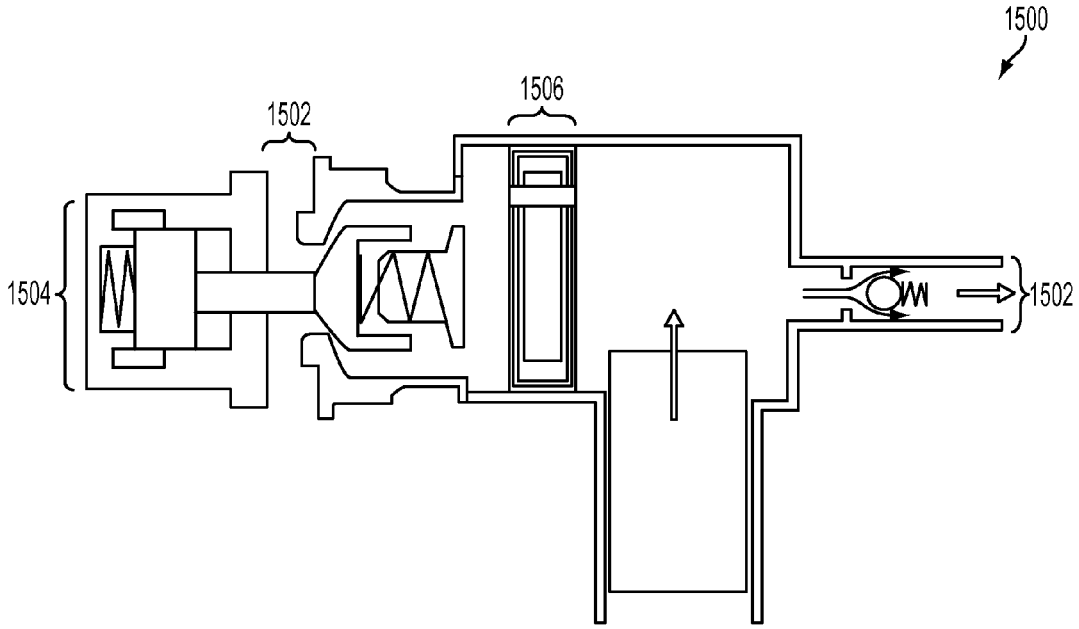
FIG. 15 shows a fourth example fuel pump.

FIG. 15 shows another example fuel pump 1500. The fuel pump 1500 may be included in the fuel delivery system 30 shown in FIG. 1. The fuel pump 1500 may be included in the fuel delivery system 30 shown in FIG. 1. The fuel pump 1500 includes an inlet 1502 in fluidic communication with upstream components, such as a fuel tank. The fuel pump 1500 further includes an MSV 1504. The MSV 1504 may have similar structural and functional characteristics to the MSV 706 shown in FIGS. 7-14. The fuel pump 1500 further includes a noise-reducing valve 1506 positioned downstream of the MSV 1504. The noise-reducing valve 1506 may have similar structural and functional characteristics to the noise-reducing valve 704 shown in FIGS. 7-14. The fuel pump 1500 further includes an outlet 1508 in fluidic communication with downstream components such as a fuel injector and/or fuel rail.

Figure 16:
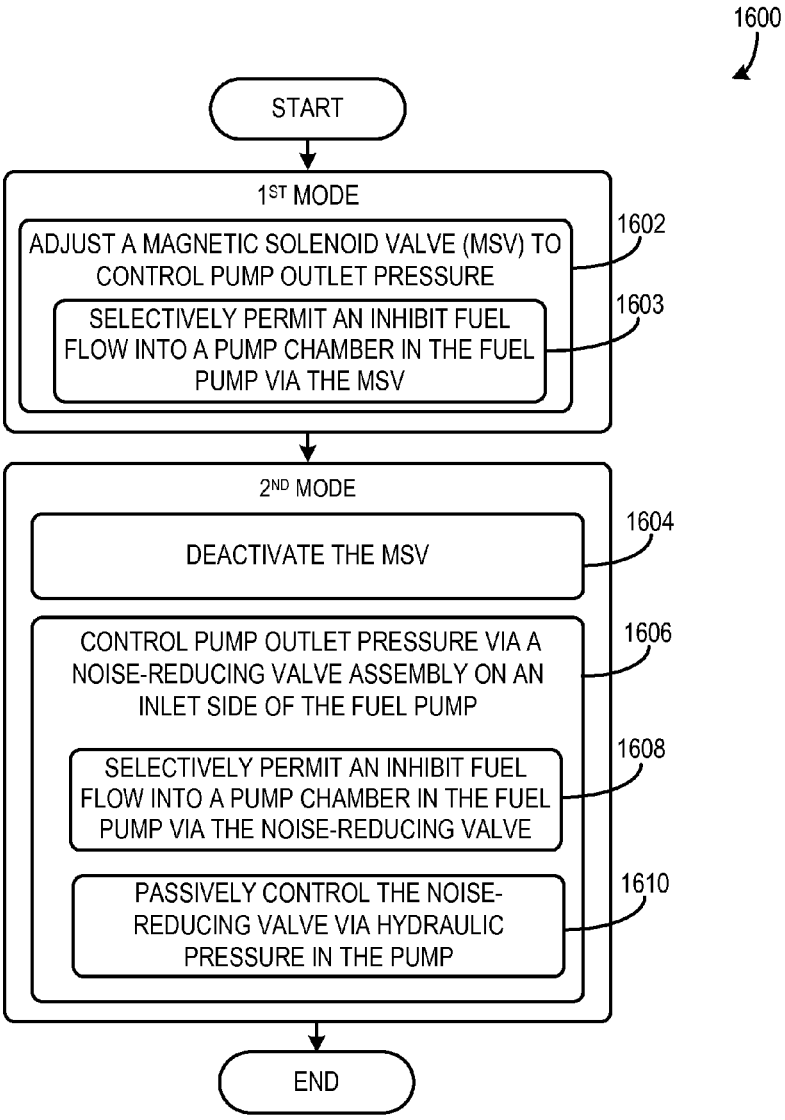
FIGS. 16-17 show different methods for operating a vapor storage device.

FIG. 16 shows a method 1600 of pressuring fuel for a direct injection fuel system via a fuel pump in an engine. The method 1600 may be implemented via the vehicle, engine, fuel delivery system, etc., described above with regard to FIGS. 1-13 or may be implemented via other suitable vehicles, engines, and/or fuel delivery systems.

At 1602 the method includes adjusting a magnetic solenoid valve (MSV) to control pump outlet pressure. Controlling pump outlet pressure may include selectively permitting an inhibiting fuel flow into a pump chamber in the fuel pump via the MSV at 1603. In one example, where the fuel is selectively permitted and inhibited to flow into the pump chamber during at least one of a delivery stroke and an intake stroke of a pump.

Next at 1604 the method includes deactivating the MSV and at 1606 the method includes controlling pump outlet pressure via a noise-reducing valve assembly on an inlet side of the fuel pump. Deactivating the MSV includes deactivating the MSV in an open position where fuel is permitted to flow therethrough. Controlling pump outlet pressure may include selectively permitting an inhibiting fuel flow into a pump chamber in the fuel pump via the noise-reducing valve at 1608 and passively controlling the noise-reducing valve via hydraulic pressure in the pump at 1610. In one example, where the fuel is selectively permitted and inhibited to flow into the pump chamber during at least one of a delivery stroke and an intake stroke of a pump.

Steps 1602 and steps 1604-1606 are implemented during different operating modes of the pump. Specifically, step 1602 may be implemented during a first mode and steps 1604 and 1606 may be implemented during a second mode. The first mode may include an operating condition when the engine is over a threshold speed and the second mode includes an operating condition when the engine is below the threshold speed, in one example. Further in other examples, the first mode may include a first engine speed range and the second mode may include a second engine speed range different from the first engine speed range. Further in one example, the first mode may include an operating condition where the fuel pump is performing a delivery stroke. The second mode may include an operating condition when the fuel pump is performing an intake stroke. It will be appreciated that the delivery stroke and the intake stroke may performed by a plunger which alters the size of a pump chamber in the pump. Further in some examples, the first mode and second mode may include engine load operating conditions (e.g., threshold values, load ranges, etc.) In the first mode a pressure in a fuel rail may be greater than a pressure in the fuel rail during the second mode. The fuel rail may be positioned downstream of the fuel pump. Additionally, it will be appreciated that the pressure in the fuel rail during the second mode is greater than a pressure in a fuel line upstream of the pump.

Figure 17:
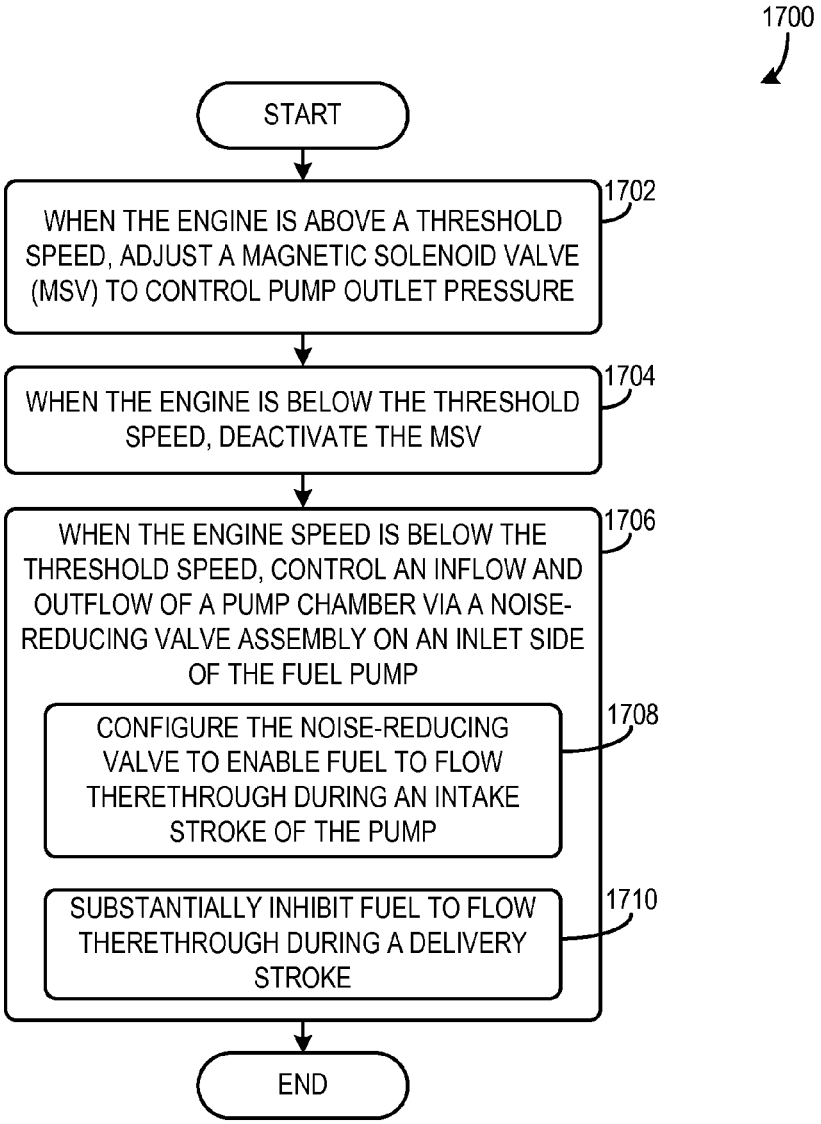

FIG. 17 shows a method 1700 of pressuring fuel for a direct injection fuel system via a fuel pump in an engine. The method 1700 may be implemented via the vehicle, engine, fuel delivery system, etc., described above with regard to FIGS. 1-13 or may be implemented via other suitable vehicles, engines, and/or fuel delivery systems.

The method includes at 1702 when the engine is above a threshold speed, adjusting a magnetic solenoid valve (MSV) to control pump outlet pressure. The threshold speed may be associated with idle operation, in one example. Therefore, the engine may be in idle operation when the engine speed is below the threshold value. Idle operation may be an engine operating mode where there is no request for vehicle acceleration, from a pedal for example. Therefore, the pedal may be released during idle operation. Additionally, the engine may be maintained at a desired speed during idle.

The method includes when the engine is below the threshold speed, deactivating the MSV at 1704 and controlling an inflow and outflow of a pump chamber via a noise-reducing valve assembly on an inlet side of the fuel pump at 1706. In one example, when the engine is below the threshold speed the deactivated MSV is deactivated in an open position during an intake stroke of the fuel pump. Controlling the inflow and outflow of the pump chamber via the noise-reducing valve includes configuring the noise-reducing valve to enable fuel to flow therethrough during an intake stroke of the pump at 1708 and substantially inhibit fuel to flow therethrough during a delivery stroke at 1710. It will be appreciated that steps 1704 and 1706 may be implemented during a cold start when the engine is below a threshold temperature.

Note that the example control and estimation routines included herein can be used with various engine and/or vehicle system configurations. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method of pressuring fuel for a direct injection fuel system via a fuel pump in an engine, comprising:

during a first mode, adjusting a magnetic solenoid valve (MSV) to control pump outlet pressure; and during a second mode, deactivating the MSV and controlling pump outlet pressure via a noise-reducing valve assembly on an inlet side of the fuel pump, where the noise-reducing valve assembly includes a spool valve and a reed valve.

2. The method of claim 1, where the first mode includes an operating condition when the engine is over a threshold speed and the second mode includes an operating condition when the engine is below the threshold speed.

3. The method of claim 1, where controlling pump outlet pressure includes selectively permitting an inhibiting fuel flow into a pump chamber in the fuel pump, and wherein the noise-reducing valve assembly includes a check valve and is only mechanically actuated.

4. The method of claim 3, where the fuel is selectively permitted and inhibited to flow into the pump chamber during at least one of a delivery stroke and an intake stroke of the fuel pump.

5. The method of claim 1, where the first mode includes an operating condition when the fuel pump is performing a delivery stroke.

6. The method of claim 1, where the second mode includes an operating condition when the fuel pump is performing an intake stroke, and wherein during the second mode, the MSV valve is not electrically adjusted.

7. The method of claim 1, where during the second mode the deactivated MSV is deactivated in an open position.

8. The method of claim 1, where controlling pump outlet pressure via the noise-reducing valve assembly includes passively, mechanically, controlling the noise-reducing valve assembly via hydraulic pressure in the fuel pump.

9. A fuel pump comprising:

a magnetic solenoid valve (MSV) positioned on an inlet side of the fuel pump controlling a pump outlet pressure during a first mode; and a noise-reducing valve assembly positioned on an inlet side of the fuel pump selectively controlling a pump outlet pressure during a second mode, where the noise-reducing valve assembly includes a spool valve and a reed valve.

10. The fuel pump of claim 9, where the MSV is positioned downstream of the noise-reducing valve assembly.

11. The fuel pump of claim 9, where the MSV is positioned upstream of the noise-reducing valve assembly.

12. The fuel pump of claim 9, where the spool valve includes a rotating spool valve.

13. The fuel pump of claim 9, where the spool valve includes a first port in fluidic communication with the reed valve and a second port in parallel fluidic communication with the first port.

14. The fuel pump of claim 9, further comprising a one way discharge valve in fluidic communication with a pump chamber and a downstream fuel rail.

15. The fuel pump of claim 9, where the noise-reducing valve assembly includes a hydraulic valve.

16. The fuel pump of claim 9, where the MSV is in series fluidic communication with the noise-reducing valve assembly.

17. A method of pressuring fuel for a direct injection fuel system via a fuel pump in an engine, comprising when the engine is above a threshold speed, adjusting a magnetic solenoid valve (MSV) to control pump outlet pressure; and when the engine is below the threshold speed, deactivating the MSV and controlling an inflow and outflow of a pump chamber via a noise-reducing valve assembly on an inlet side of the fuel pump, where the noise-reducing valve assembly includes a spool valve and a reed valve.

18. The method of claim 17, where controlling the inflow and outflow of the pump chamber via the noise-reducing valve assembly includes configuring the noise-reducing valve assembly to enable fuel to flow therethrough during an intake stroke of the fuel pump and substantially inhibit fuel to flow therethrough during a delivery stroke.

19. The method of claim 17, when the engine is below the threshold speed, the deactivated MSV is deactivated in an open position during an intake stroke of the fuel pump.

* * * * *